US007097489B2

(12) United States Patent
Yen et al.

(10) Patent No.: US 7,097,489 B2
(45) Date of Patent: Aug. 29, 2006

(54) HID LAMP SOCKET

(75) Inventors: Tuan-Hung Yen, Hsin-Chuang (TW); Pei-Fen Wu, Hsin-Chuang (TW)

(73) Assignee: Tekcon Electronics Corp., Hsin-Chuang (TW)

( * ) Notice: Subject to any disclaimer, the term of this patent is extended or adjusted under 35 U.S.C. 154(b) by 0 days.

(21) Appl. No.: 11/064,248

(22) Filed: Feb. 22, 2005

(65) Prior Publication Data

US 2005/0186825 A1 Aug. 25, 2005

(30) Foreign Application Priority Data

Feb. 20, 2004 (TW) ..... 93202450 U

(51) Int. Cl.
*H01R 13/625* (2006.01)

(52) U.S. Cl. ..... 439/336; 439/918

(58) Field of Classification Search ..... 439/188, 439/332, 336, 673, 674, 918; 200/51.08
See application file for complete search history.

(56) References Cited

U.S. PATENT DOCUMENTS

| | | | | |
|---|---|---|---|---|
| 3,600,532 | A * | 8/1971 | Priesemuth | 200/61.45 R |
| 4,141,062 | A * | 2/1979 | Trueblood | 362/400 |
| 4,804,343 | A * | 2/1989 | Reedy | 439/854 |
| 5,197,187 | A * | 3/1993 | Thomas | 29/863 |
| 5,897,391 | A * | 4/1999 | Takahashi et al. | 439/336 |
| 6,224,428 | B1 * | 5/2001 | Chen et al. | 439/694 |

* cited by examiner

*Primary Examiner*—Thanh-Tam Le
(74) *Attorney, Agent, or Firm*—Wei Te Chung

(57) ABSTRACT

An HID lamp socket (1), which connects an HID lamp (9) with an electrical device, includes an insulative housing (10), a number of first electrical terminals (20) received in the housing and a number of second electrical terminals (30) for contacting the first electrical terminals to a number of wires (34) extending from the electrical device. The first electrical terminals include a high-voltage terminal (21), a low-voltage terminal (22) and two switch terminals (23). The switch terminal has a cantilever (231) extending transversely and slantwise and a contact tab (233) extending downwardly from the cantilever.

10 Claims, 9 Drawing Sheets

HID LAMP SOCKET

BACKGROUND OF THE INVENTION

1. Field of the Invention

The present invention relates to a lamp connector, and especially to a high intensity discharge (HID) lamp socket.

2. Description of the Prior Art

A conventional HID lamp socket is used to connect a HID lamp to wires extending from an electrical device. The electrical device is used to supply the connector with desired voltage. The connector includes a housing and a plurality of first electrical terminals and second electrical terminals received in the housing. The first electrical terminals engage with the second electrical terminals. One of the second electrical terminals is slidably assembled in the housing and is slid to a final position where it electrically connects two of the first electrical terminals when the HID lamp is assembled to the connector to a final position. For the electrical circuit is not formed and the high voltage to arouse the HID lamp is not generated until the lamp is assembled to the final place, the danger decreases greatly in assembly or disassembly of the HID lamp.

The present invention provides anther HID lamp socket to achieve the same objects described above but in a different structure.

BRIEF SUMMARY OF THE INVENTION

An object of the present invention is to provide a lamp socket that only when a lamp is substantially assembled in the lamp socket does the lamp socket provide an electrical connection between a lamp and an electrical device.

A lamp socket, which connects a lamp with an electrical device, comprises an insulative housing having a receiving cavity for the lamp to be inserted therein, a plurality of first electrical terminals received in the housing and a plurality of second electrical terminals for electrically contacting a plurality of wires extending from the electrical device to the first electrical terminals. The first electrical terminals include a high-voltage terminal, a low-voltage terminal and at least a switch terminal. The switch terminal comprises a securing portion, a cantilever extending slantwise upwardly from an upper end of the securing portion and a contacting portion locating at a free end of the cantilever. When the lamp is substantially seated in the socket, the free end of the cantilever is pressed down and the contacting portion engages the low-voltage terminal, and so the desired electrical connection is provided.

DETAILED DESCRIPTION OF THE INVENTION

Figure 1:
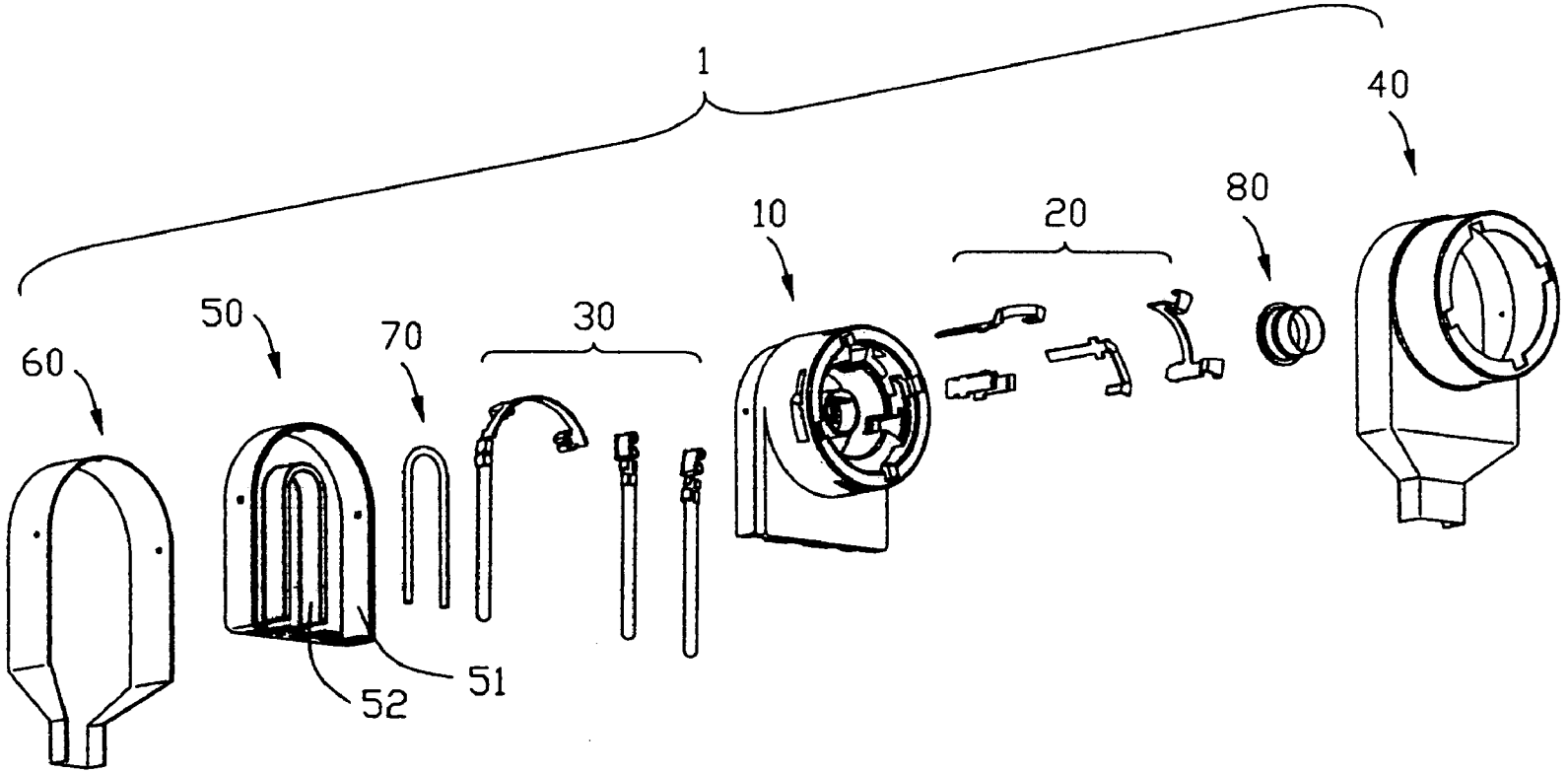
FIG. 1 is an exploded view of an HID lamp socket according to the present invention.

FIG. 1 is an exploded view of an HID lamp socket 1 used to electrically connecting an HID lamp 9 (shown in FIG. 7) to an electrical device (not shown). The HID lamp socket 1 comprises an insulative housing 10, a plurality of first electrical terminals 20 received in the housing 10, a plurality of second electrical terminals 30, a bottom cover 50, an top shell 40, a bottom shell 60, an inner seal ring 80 and an outer seal ring 70. Each of the second electrical terminals 30 crimps a wire 34 (shown in FIG. 6) extending from an electrical device.

Figure 2:
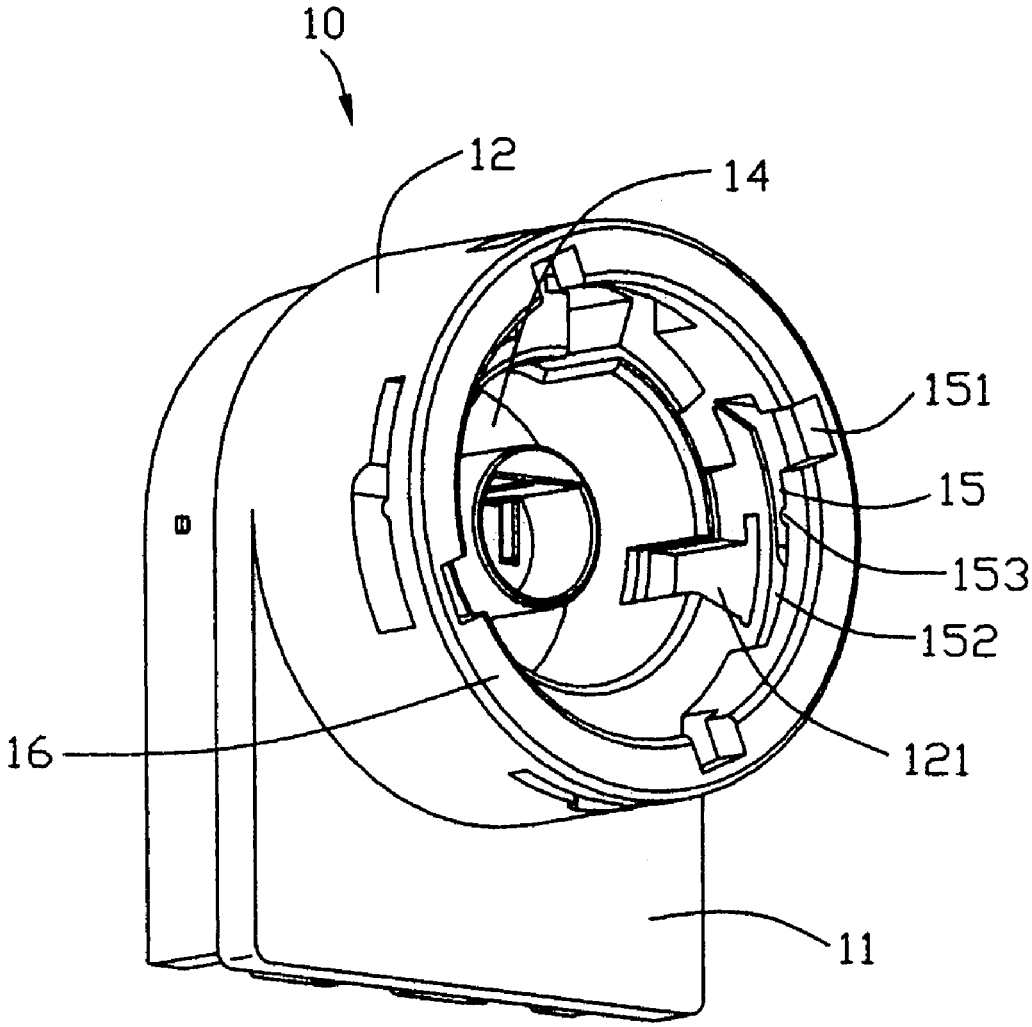
FIG. 2 is a perspective view of a housing of the HID lamp socket.
Figure 5:
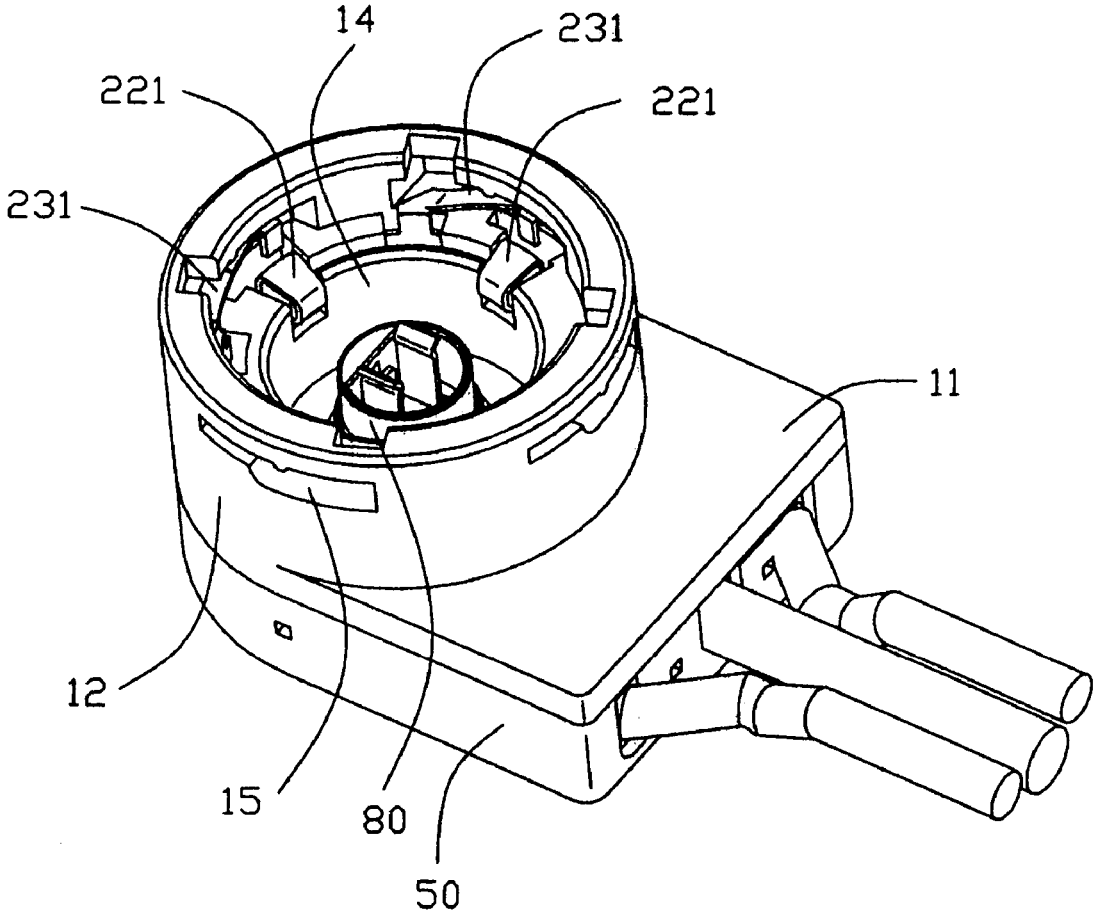
FIG. 5 is a perspective view of the HID lamp socket.
Figure 6:
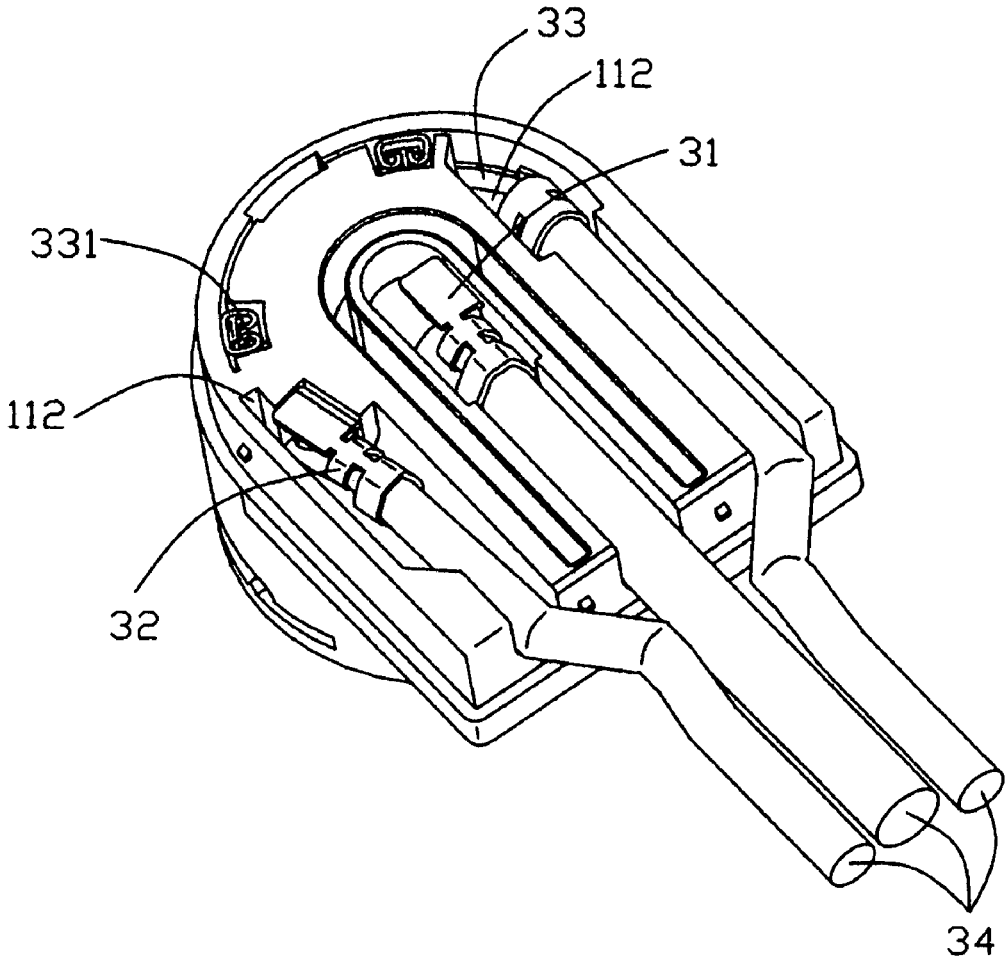
FIG. 6 is another perspective view with a bottom housing member being removed therefrom.

Referring to FIGS. 2, 5 and 6, the housing 10 comprises a base 11 and a cylinder body 12 extending upwardly from the base 11. The base 11 defines a plurality of receiving slots 112 in a bottom side for receiving the wires 34, the second electrical terminals 30 and the outer seal ring 70. The cylinder body 12 defines a receiving cavity 14 surrounded by a circular sidewall 16. Four horizontal slots 15 equidistantly array along and cut through the circular sidewall 16. The circular sidewall 16 further forms four protuberances 153 protruding downwardly into each of the horizontal slot 15. Four guide grooves 151 are defined in a top face of the circular sidewall 16 and vertically extend toward and communicate with respective horizontal slots 15.

Figure 3:
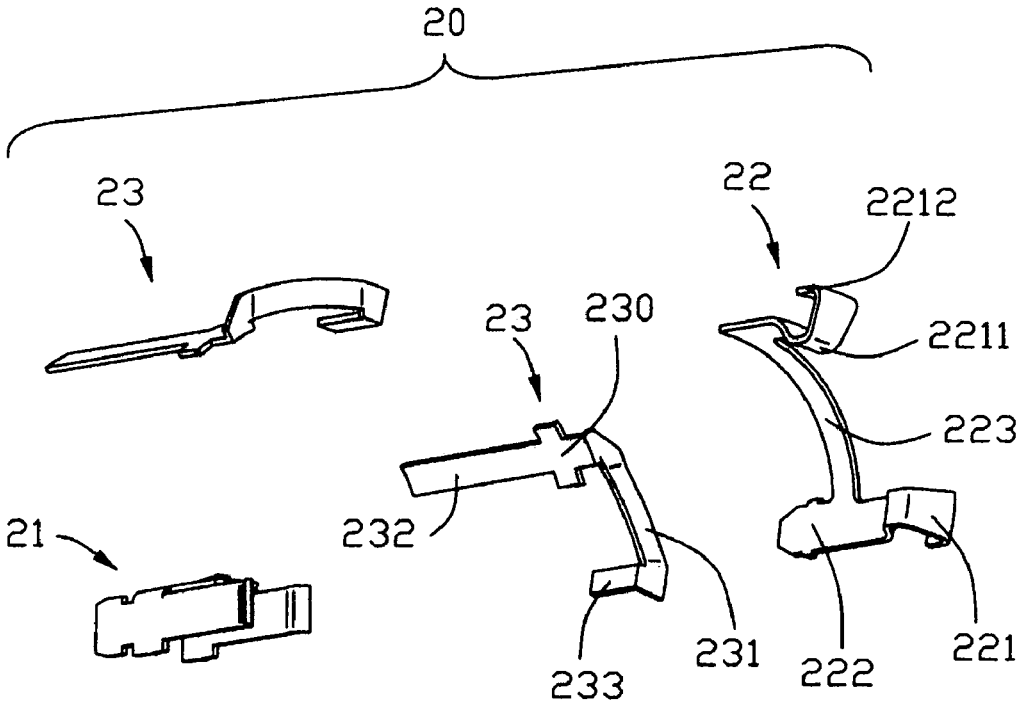
FIG. 3 is a perspective view of a plurality of first electrical terminals of the HID lamp socket.

Referring to FIGS. 3 and 5, the first electrical terminals 20 include a high-voltage terminal 21, a low-voltage terminal 22 and two switch terminals 23. The low-voltage terminal 22 comprises a right-angle-arc connecting portion 223, a mating portion 222 extending downwardly from an end of the connecting portion 223, and a pair of contacting portion 221 extending upwardly respectively from opposite ends of the connecting portion 223. Each contacting portion 221 includes a first contacting portion 2211 connected to the connecting sheet 223 and a second contacting portion 2212 connected to the first contacting portion 2211. The first contacting portion 2211 protrudes inwardly and the second contacting portion 2212 protrudes outwardly with respect to the connecting sheet 223. Each of switch terminals 23 comprises a securing portion 230 for securing the switch terminal 23 in the housing 10, a strip 232 extending downwardly from the securing portion 230, a cantilever 231 extending transversely in an upward slant from an upper end of the securing portion 230 and a contact tab 233 extending downwardly from a free end of the cantilever 231. The cantilever 231, which is shaped into a 24-degree arc and bent perpendicularly to the securing portion 230, is used to provide adequate elasticity.

Figure 4:
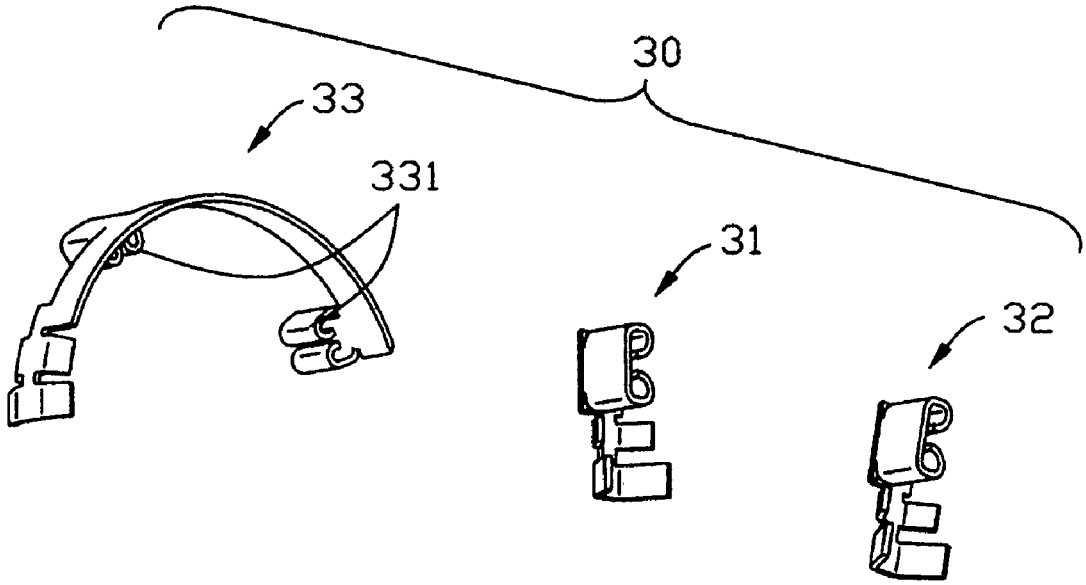
FIG. 4 is a perspective view of a plurality of second electrical terminals of the HID lamp socket.

Referring to FIG. 4, the second electrical terminals 30 include a first cable end terminal 31, a second cable end terminal 32 and a third cable end terminal 33. Each of the second electrical terminals 30 crimps a wire 34 extending from the electrical device (not shown). The third cable end terminal 33 is shaped in an arc shape and forms two mating portions 331 disposed in about a right angle.

Referring to FIG. 6, the second electrical terminals 30 are installed in respective receiving slots 112. The outer seal ring 70 is arranged surrounding the first cable end terminal 31.

Referring to FIGS. 5 and 6, the first electrical terminals 20 are electrically connected to respective second electrical terminals 30. The high-voltage terminal 21, which is set in the center of the receiving cavity 14, is connected with the first cable end terminal 31. The switch terminals 23, which are disposed in two adjacent horizontal slots 15, are respectively connected to the mating portions 331 of the third cable end terminal 33. The low-voltage terminal 22, which is arranged in the receiving cavity 14 in a concentric position with respective to the circular sidewall 16 and the contacting portions 221 of which are disposed under respective contact tabs 233 of the switch terminals 23, is connected to the second cable end terminal 32.

The bottom cover 50 is positioned on a bottom side of the housing 10. The top shell 40 and the bottom shell 60 cover the combination of the housing 10 and the bottom cover 50.

Figure 7:
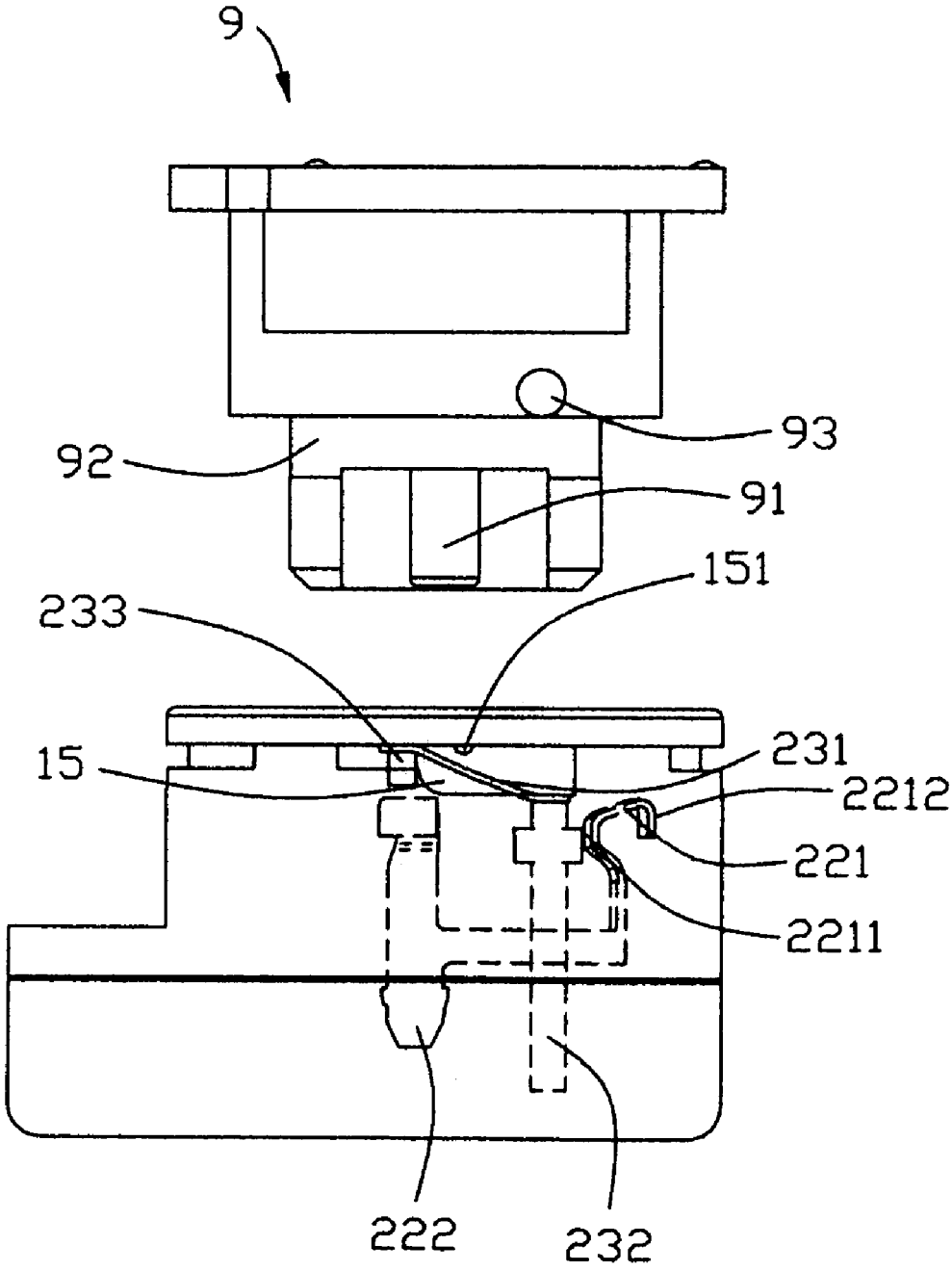
FIG. 7 is a side view of the HID lamp socket with a high-voltage terminal and a switch terminal shown in hidden lines before an HID lamp inserted thereinto.
Figure 8:
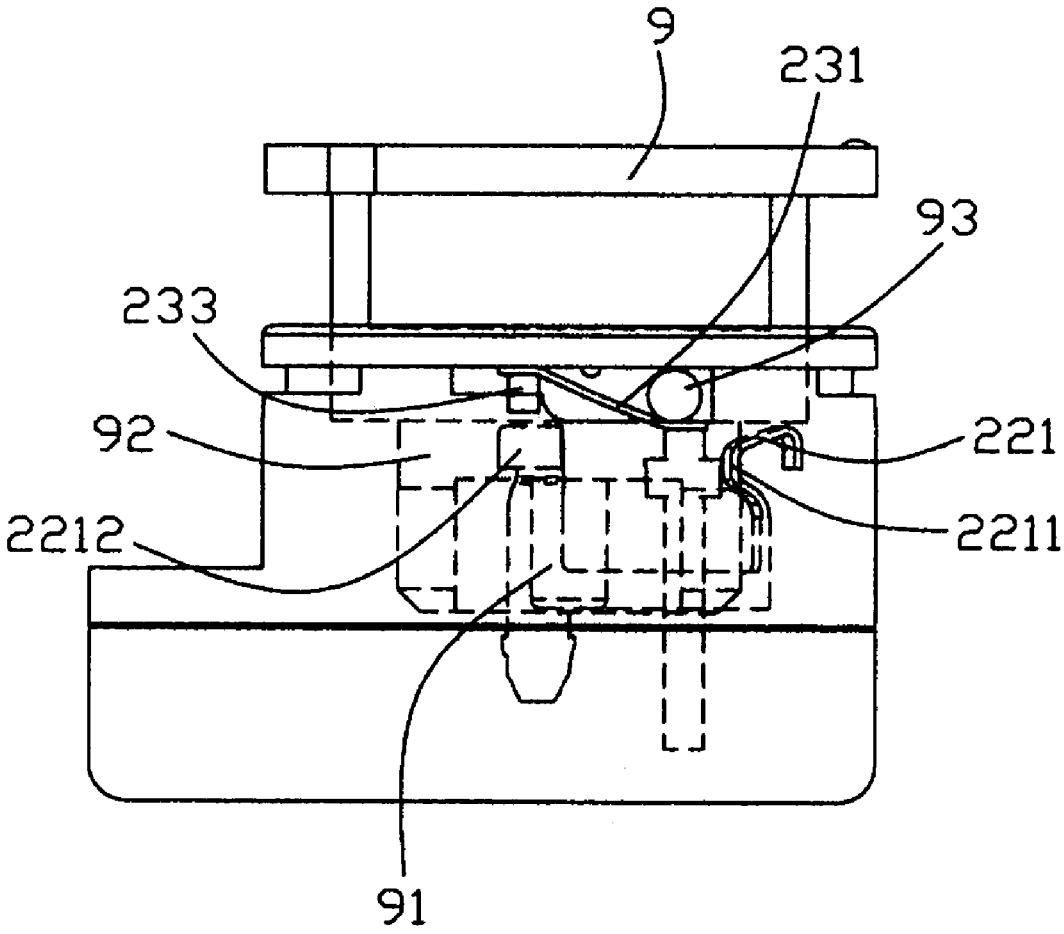
FIG. 8 is a similar view to FIG. 7, but the HID lamp is inserted in the housing.
Figure 9:
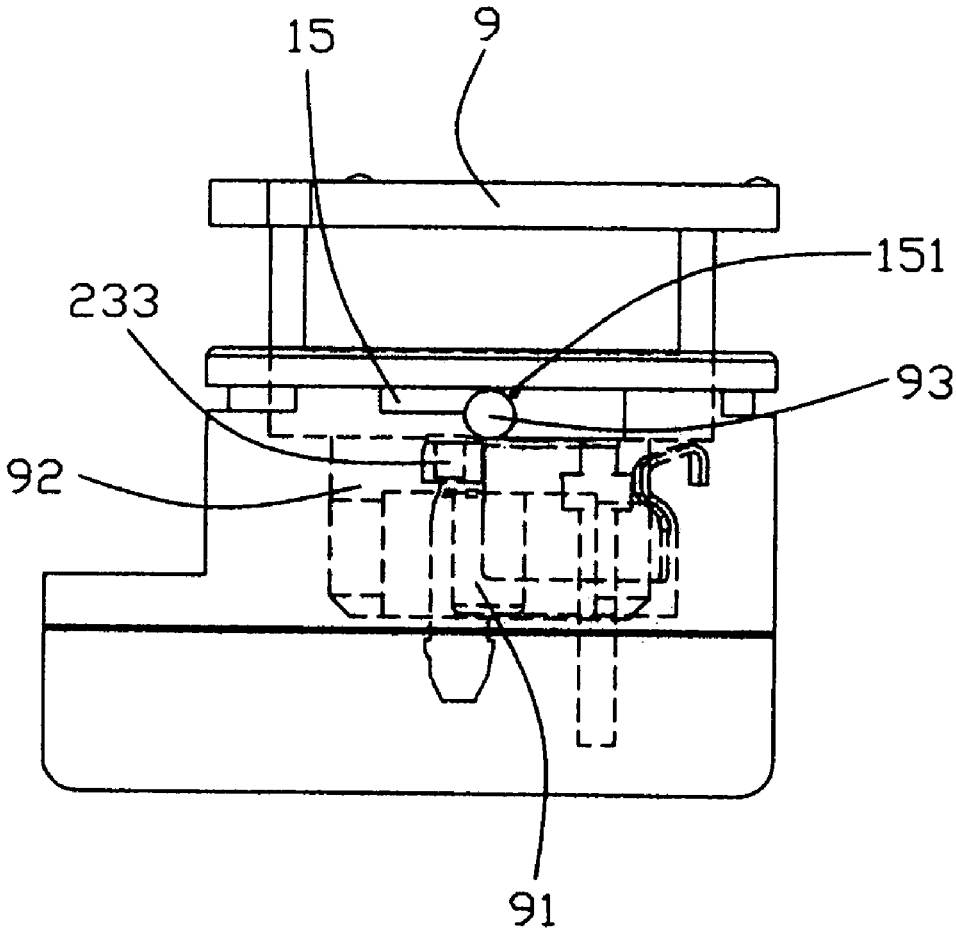
FIG. 9 is a similar view to FIG. 8, but the HID lamp is rotated to a final position and the switch terminal is pressed down.

Referring to FIGS. 7, 8 and 9, the HID lamp 9 comprises a central electrode 91 and a circular electrode 92 and a pair of blocks 93. When the HID lamp 9 is initially inserted into the receiving cavity 14 of the connector 1, the central electrode 91 contacts the high-voltage terminal 21 and the circular electrode 92 biases against the first contacting portion 2211 of the low-voltage terminal 22, at the same time, one of the blocks 93 rests on the up end of the securing portion 230 of the switch terminal 23. When the HID lamp is rotated a 24-degree angle, the blocks 93 slide along the horizontal slots 15 to a final position and get locked by corresponding protuberances 151 thereof. In this process, the blocks 93 press down one of the cantilevers 231, so that corresponding contact tab 233 moves downward and biases on the second contacting portion 2212 of the low-voltage terminal 22.

It is to be understood, however, further though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent identify by the broad general meaning of the terms in which the appended claims are expressed.

What is claimed is:

1. A lamp socket, which connects a lamp having a pair of blocks with an electrical device, comprising;

an insulative housing having a receiving cavity for the lamp to be assembled therein;

a plurality of first electrical terminals received in the housing, the first electrical terminals including:

a high-voltage terminal and a low-voltage terminal for electrically connecting the lamp; and at least one switch terminal, the at least one switch terminal comprising a securing portion, a cantilever extending transversely and slantwise from an upper end of the securing portion and a contacting portion connecting to the cantilever; and a plurality of second electrical terminals for connecting a plurality of wires extending from the electrical device to the first electiical terminal;

wherein with the rotatablely assembling of the lamp to the lamp socket, the cantilever of the switch contact is pressed down, and the contacting portion electrically contacts with the low-voltage terminal when the lamp is substantially received in the lamp socket.

2. The lamp socket according to the claim 1, wherein the at least one switch terminal further forms a strip extending downwardly from the securing portion, a lower end of said strip mating with one of said second electrical terminals.

3. The lamp socket according to the claim 1, wherein the lower-voltage terminal forms a contacting portion and one of the second electrical terminals forms a mating portion for engaging with said at least one switch terminal, respectively, whereby said lower-voltage terminal is electrically connectable to said second electrical terminal through the at least switch terminal.

4. The lamp socket according to the claim 1, wherein the receiving cavity is defined by a circular sidewall, and the circular sidewall further defines four horizontal slots equidistantly arrayed along the circular sidewall for receiving the cantilever of the switch terminal, so that when the blocks of the lamp slide along the horizontal slots, they press downward said cantilever.

5. The lamp socket according to the claim 4, wherein the housing defines four guide grooves in a top face, the guiding grooves extending downwardly along an inner face of the circular sidewall and communicating with respective horizontal slots.

6. The lamp socket according to the claim 4, wherein the circular sidewall forms four protuberances protruding downwardly into respective horizontal slots, and wherein when the lamp is assembled to the lamp socket, the protuberances mate with the blocks of the lamp.

7. The lamp socket according to the claim 1, wherein the lower-voltage terminal comprises an arc-shaped connecting portion and a contacting portion disposed under the contacting portion of the switch terminal.

8. The lamp socket according to the claim 7, wherein said contacting pardon of the lower-voltage terminal further comprises a first contacting portion and a second contacting portion, and wherein when the lamp is substantially assembled in the socket, the first contacting portion flexibly biases inwardly on the lamp and the second contacting portion flexibly biases outwardly on the contacting portion of the switch terminal.

9. The lamp socket according to the claim 1, wherein the cantilever of the switch terminal is shaped into a 24-degree arc and is bent perpendicularly to the securing portion.

10. A lamp socket assembly comprising:

an insulative housing having a receiving cavity;

a lamp assembled in the receiving cavity;

a voltage-relating terminal disposed in the housing and electrically connecting to a wire for electrically connecting the lamp; and at least one switch terminal disposed in the housing and defining a detlectable portion with a contacting portion thereon and electrically connecting to another wire;

wherein during assembling, rotation of the lamp to the lamp socket results in deflection of the deflectable portion along an axial direction of rotation of said lamp so as to have the contacting portion engage the voltage-relating terminal;

wherein said deflection portion essentially extends in a circumferential path; and wherein said lamp includes a block located on a periphery thereof to actuate deflection of the deflection portion during said rotation of the lamp.

* * * * *